US006533485B1

(12) United States Patent
Bland

(10) Patent No.: US 6,533,485 B1
(45) Date of Patent: Mar. 18, 2003

(54) COMBINATION TOOTHBRUSH AND TOOTHPASTE DISPENSER WITH INCORPORATED REMAINING USE COUNTER

(76) Inventor: Robert Bland, 219-24 121st Ave., Cambria Heights, NY (US) 11411

( * ) Notice: Subject to any disclaimer, the term of this patent is extended or adjusted under 35 U.S.C. 154(b) by 0 days.

(21) Appl. No.: 10/055,482

(22) Filed: Jan. 22, 2002

(51) Int. Cl.[7] ..... A46B 11/04

(52) U.S. Cl. ..... 401/270; 401/194; 401/277; 401/176; 401/179; 401/172

(58) Field of Search ..... 401/270, 194, 401/277, 282, 171, 172, 176, 177, 179, 174

(56) References Cited

U.S. PATENT DOCUMENTS 2,250,758 A * 7/1941 French ..... 401/194

3,078,011 A * 2/1963 Safianoff ..... 401/194

* cited by examiner

*Primary Examiner*—David J. Walczak
(74) *Attorney, Agent, or Firm*—Goldstein & Lavas, P.C.

(57) ABSTRACT

A combination toothbrush and toothpaste dispenser with incorporated remaining use counter including a toothbrush portion comprised of an elongated hollow handle having an incorporated head portion. The elongated hollow handle includes an internal channel. The head portion has a plurality of openings in communication with the internal channel. The head portion has a plurality of bristles extending outwardly thereof. The handle holds a quantity of toothpaste within the internal channel. An internal plunger is disposed within the internal channel of the elongated hollow handle. The internal plunger will force the toothpaste out of the plurality of openings of the head portion and onto the bristles. A counter is disposed within the elongated hollow handle of the toothbrush portion. The counter is in communication with the plunger for determining a remaining amount of toothpaste disposed therein, and displaying the same on a rotary dial.

7 Claims, 3 Drawing Sheets

COMBINATION TOOTHBRUSH AND TOOTHPASTE DISPENSER WITH INCORPORATED REMAINING USE COUNTER

CROSS REFERENCES AND RELATED SUBJECT MATTER

This application relates to subject matter contained in U.S. patent application Ser. No. 09/659,440 filed in the United States Patent Office on Sep. 8, 2000.

BACKGROUND OF THE INVENTION

The present invention relates to a combination toothbrush and toothpaste dispenser with incorporated remaining use counter and more particularly pertains to allowing toothpaste to be added to the toothbrush from an interior of the toothbrush while keeping track of remaining uses prior to disposal.

The use of combination toothbrush devices is known in the prior art. More specifically, combination toothbrush devices heretofore devised and utilized for the purpose of aiding in the brushing of teeth are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,622,984 to Gaebel discloses a combination toothbrush and toothpaste dispenser with an indicator window and a hand operated plunger for advancing the paste. U.S. Pat. No. 4,583,563 to Turner and U.S. Pat. No. 5,909,977 to Kuo disclose additional combination toothbrush devices with toothpaste dispensers incorporated.

While these devices fulfill their respective, particular objective and requirements, the aforementioned patents do not describe a combination toothbrush and toothpaste dispenser with incorporated remaining use counter for allowing toothpaste to be added to the toothbrush from an interior of the toothbrush while keeping track of remaining uses prior to disposal.

In this respect, the combination toothbrush and toothpaste dispenser with incorporated remaining use counter according to the present invention substantially departs from the conventional concepts and designs of the prior art, and in doing so provides an apparatus primarily developed for the purpose of allowing toothpaste to be added to the toothbrush from an interior of the toothbrush while keeping track of remaining uses prior to disposal.

Therefore, it can be appreciated that there exists a continuing need for a new and improved combination toothbrush and toothpaste dispenser with incorporated remaining use counter which can be used for allowing toothpaste to be added to the toothbrush from an interior of the toothbrush while keeping track of remaining uses prior to disposal. In this regard, the present invention substantially fulfills this need.

SUMMARY OF THE INVENTION

In the view of the foregoing disadvantages inherent in the known types of combination toothbrush devices now present in the prior art, the present invention provides an improved combination toothbrush and toothpaste dispenser with incorporated remaining use counter. As such, the general purpose of the present invention, which will be described subsequently in greater detail, is to provide a new and improved combination toothbrush and toothpaste dispenser with incorporated remaining use counter which has all the advantages of the prior art and none of the disadvantages.

To attain this, the present invention essentially comprises a toothbrush portion comprised of an elongated hollow handle having an incorporated head portion. The elongated hollow handle includes an internal channel. The head portion has a plurality of openings in communication with the internal channel. The head portion has a plurality of bristles extending outwardly thereof. The handle has an elongated slide track formed therein. The slide track is in communication with the internal channel. The handle holds a quantity of toothpaste within the internal channel. A slide member is slidably coupled with the slide track of the elongated hollow handle of the toothbrush portion. The slide member has an internal plunger disposed within the internal channel of the elongated hollow handle. The slide member slides within the slide track whereby the internal plunger will force the toothpaste out of the plurality of openings of the head portion and onto the bristles. A counter is disposed within the elongated hollow handle of the toothbrush portion. The counter is in communication with the internal channel for determining a remaining amount of toothpaste disposed therein. The counter has an indicator displaying a number of uses remaining prior to disposal.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved combination toothbrush and toothpaste dispenser with incorporated remaining use counter which has all the advantages of the prior art combination toothbrush devices and none of the disadvantages.

It is another object of the present invention to provide a new and improved combination toothbrush and toothpaste dispenser with incorporated remaining use counter which may be easily and efficiently manufactured and marketed.

It is a further object of the present invention to provide a new and improved combination toothbrush and toothpaste dispenser with incorporated remaining use counter which is of durable and reliable construction.

An even further object of the present invention is to provide a new and improved combination toothbrush and toothpaste dispenser with incorporated remaining use counter which is susceptible of a low cost of manufacture with regard to both materials and labor, and which accordingly is then susceptible of low prices of sale to the consuming public, thereby making such a combination toothbrush and toothpaste dispenser with incorporated remaining use counter economically available to the buying public.

Even still another object of the present invention is to provide a new and improved combination toothbrush and toothpaste dispenser with incorporated remaining use counter for allowing toothpaste to be added to the toothbrush from an interior of the toothbrush while keeping track of remaining uses prior to disposal.

Lastly, it is an object of the present invention to provide a new and improved combination toothbrush and toothpaste dispenser with incorporated remaining use counter including a toothbrush portion comprised of an elongated hollow handle having an incorporated head portion. The elongated hollow handle includes an internal channel. The head portion has a plurality of openings in communication with the internal channel. The head portion has a plurality of bristles extending outwardly thereof. The handle holds a quantity of toothpaste within the internal channel. An internal plunger is disposed within the internal channel of the elongated hollow handle. The internal plunger will force the toothpaste out of the plurality of openings of the head portion and onto the bristles. A counter is disposed within the elongated hollow handle of the toothbrush portion. The counter is in communication with the internal channel for determining a remaining amount of toothpaste disposed therein. The counter has an indicator displaying a number of uses remaining prior to disposal.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
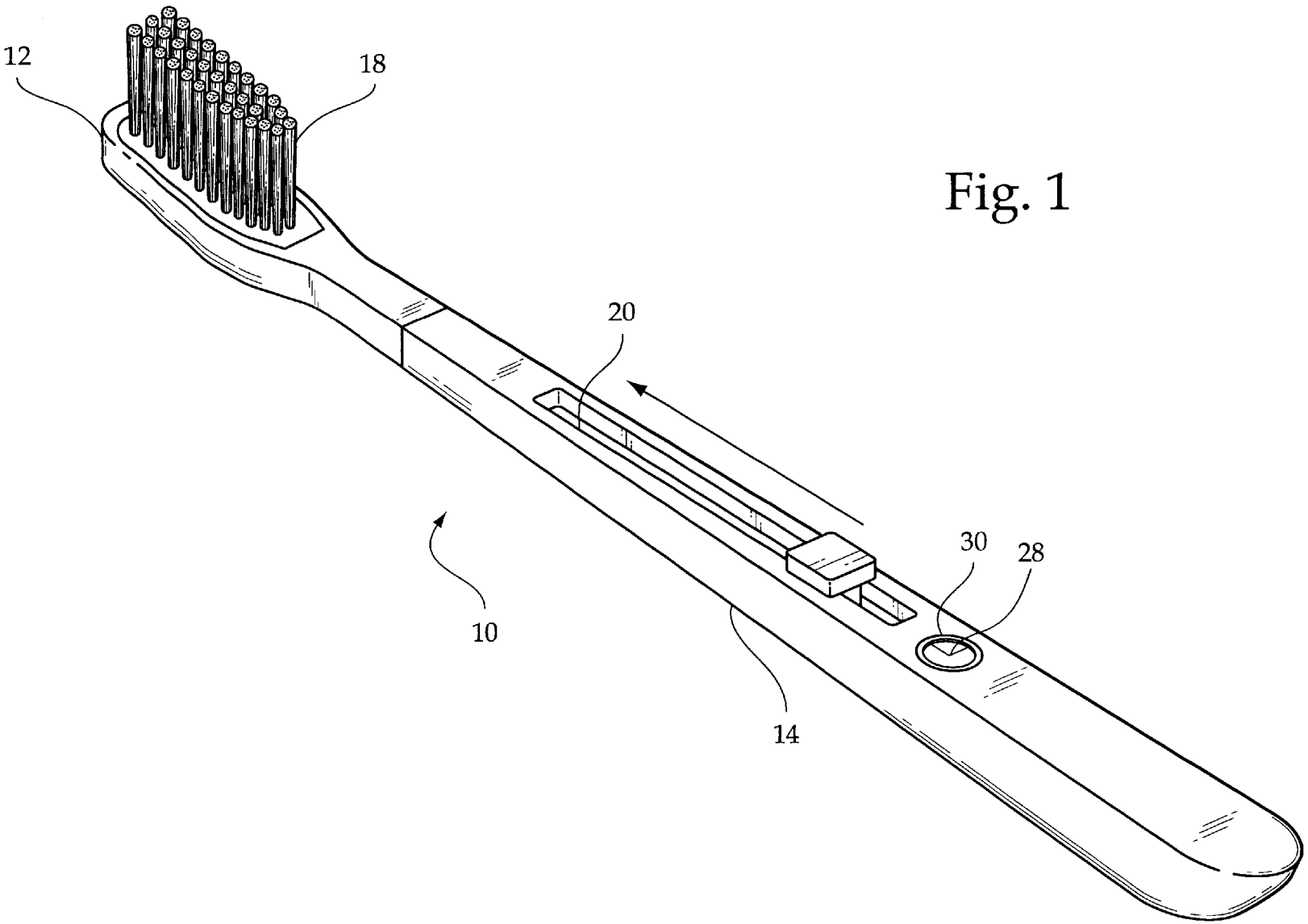
FIG. 1 is a perspective view of the preferred embodiment of the combination toothbrush and toothpaste dispenser with incorporated remaining use counter constructed in accordance with the principles of the present invention.
Figure 2:
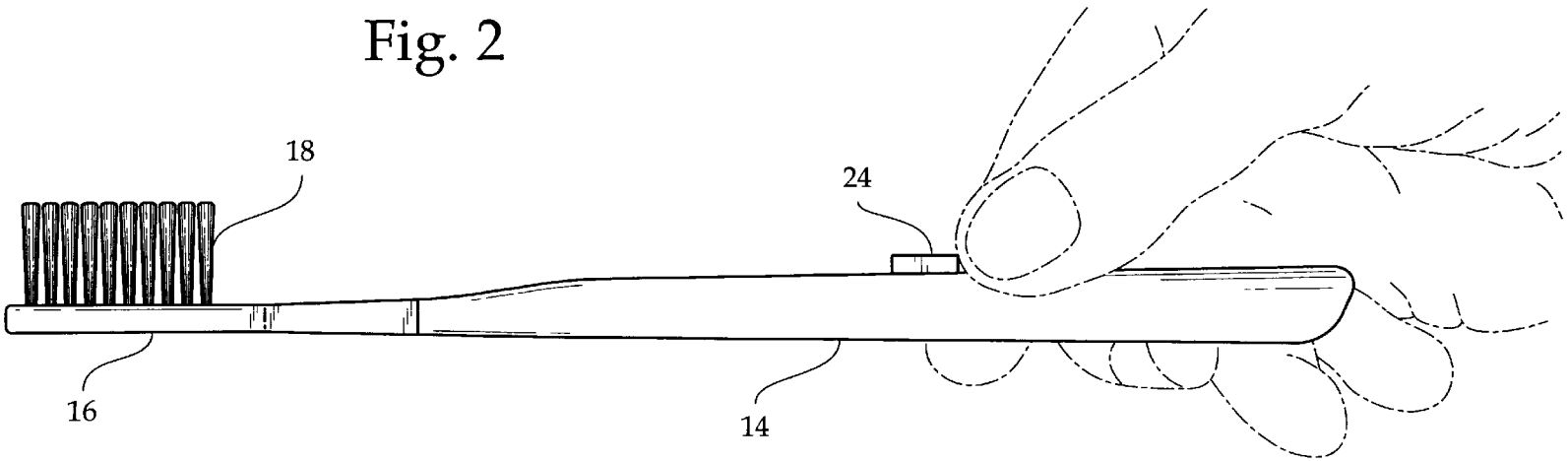
FIG. 2 is a side view of the present invention shown prior to use.
Figure 3:
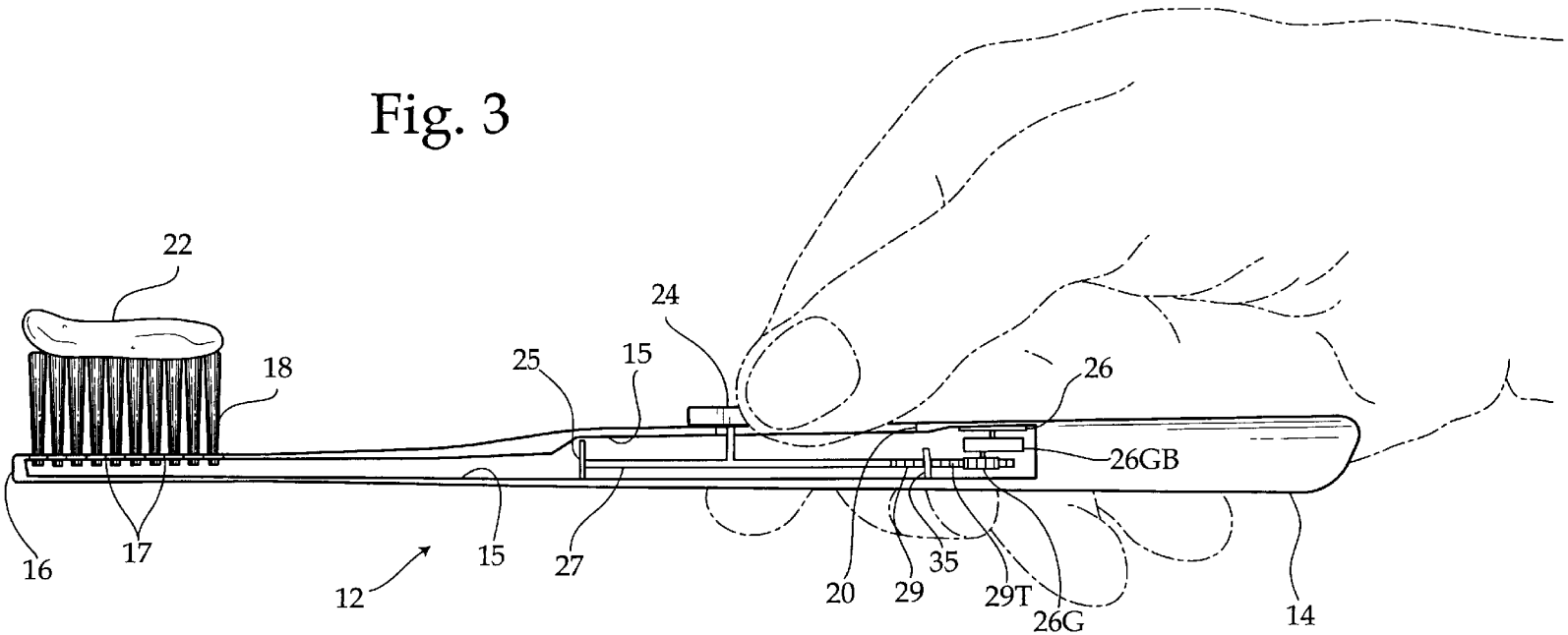
FIG. 3 is a side view of the present invention illustrating with parts broken away to illustrate internal components thereof, mainly illustrating the functional interaction between the slider, the plunger, the rack, and the counter.

With reference now to the drawings, and in particular, to FIGS. 1 through 5 thereof, the preferred embodiment of the new and improved combination toothbrush and toothpaste dispenser with incorporated remaining use counter embodying the principles and concepts of the present invention and generally designated by the reference number 10 will be described.

Specifically, it will be noted in the various figures that the device relates to a combination toothbrush and toothpaste dispenser with incorporated remaining use counter for allowing toothpaste to be added to the toothbrush from an interior of the toothbrush while keeping track of remaining uses prior to disposal. In its broadest context, the device comprises of a toothbrush portion, a plunger, a mechanism for advancing the plunger, and a counter. Such components are individually configured and correlated with respect to each other so as to attain the desired objective.

The toothbrush portion 12 is comprised of an elongated hollow handle 14 having an incorporated head portion 16. The elongated hollow handle 14 includes an internal channel 15. The head portion 16 has a plurality of openings 17 in communication with the internal channel. The head portion 16 has a plurality of bristles 18 extending outwardly thereof. The handle 14 has an longitudinal slide track 20 formed therein.

The slide member 24 is slidably coupled with the slide track 20 of the elongated hollow handle 14 of the toothbrush portion 12. An internal plunger 25 is disposed within the internal channel of the elongated hollow handle 14, and according to the first embodiment is connected to the slide member 24. The handle 14 holds a quantity of toothpaste 22 within the internal channel 15 forward of the plunger 25. The slide member 24 and internal plunger 25 may be connected by a longitudinal bar 27 which allows the internal plunger 25 to remain forward of the slide track 20 even when the slide member 24 is in its most rearward position. Accordingly, toothpaste is prevented from leaking out the slide track 20. The slide member 24 slides within the slide track 20 whereby the internal plunger will force the toothpaste 22 out of the plurality of openings 17 of the head portion 16 and onto the bristles 18. Note FIG. 3 and 4. The slide member 24 slides forwardly completely within the slide track 20 to allow a predetermined quantity of toothpaste 22 to be dispensed onto the bristles 18.

The counter 26 is disposed within the elongated hollow handle 14 of the toothbrush portion 12. The counter 26 is in communication with the longitudinal bar 27 for determining a remaining amount of toothpaste 22 disposed therein. The counter 26 is slaved to the plunger 25 for providing a visual indication, but cannot be rotated by the user to move the plunger 25. The counter 26 has a dial indicator 28 displaying the amount of usage remaining prior to disposal, and may be calibrated with radial lines to indicate an actual number of uses remaining. Once the indicator displays the number "0", or travels a complete circle, the toothbrush portion 12 is thrown away. Accordingly to the present invention, the longitudinal bar 27 may have a rack portion 29, having rack teeth 29T. Further, the counter 26 has a counter gear 26G which is engaged with the rack portion 29. Accordingly, as the longitudinal bar 27 is advanced forward by moving the slide member 24 forward, the rack teeth 29T cause the counter gear 26G to rotate, which in turn causes the counter dial to provide a visual indication concerning the overall usage of the toothpaste supply. Depending on the relative length of the slide track 20 and size of the counter gear 26G, a gear reduction box 26GB can be interposed between the counter 26 and the counter gear 26G to properly calibrate the counter 26 so that it makes a complete rotation as the slide member 24 moves between its limits of travel within the slide track 20.

It is desirable to have the toothbrush "click" to indicate to the user that a desired "serving" of toothpaste has been dispensed. The same may be accomplished in numerous ways. However, according to the embodiments illustrated of the present invention, a simple flexible plate 35 may be positioned within the housing and in the path of the rack teeth 29T. Accordingly, as each of the teeth 29T moves past the flexible plate 35, it will flex and snap-back to make a click sound. The relative spacing of the teeth 29T can be calibrated to control how much toothpaste is dispensed "per click", or the user can be informed that the proper "serving" on toothpaste is dispensed after a certain number of clicks (e.g. 5 clicks).

Figure 5:
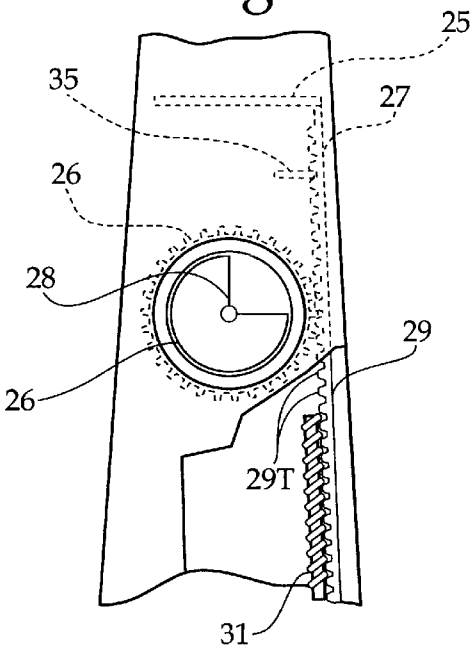
FIG. 5 is a partial top plan view of the present invention illustrating the use counter thereof, with parts broken away, illustrating cooperative engagement between the worm gear, rack, and counter.
Figure 4:
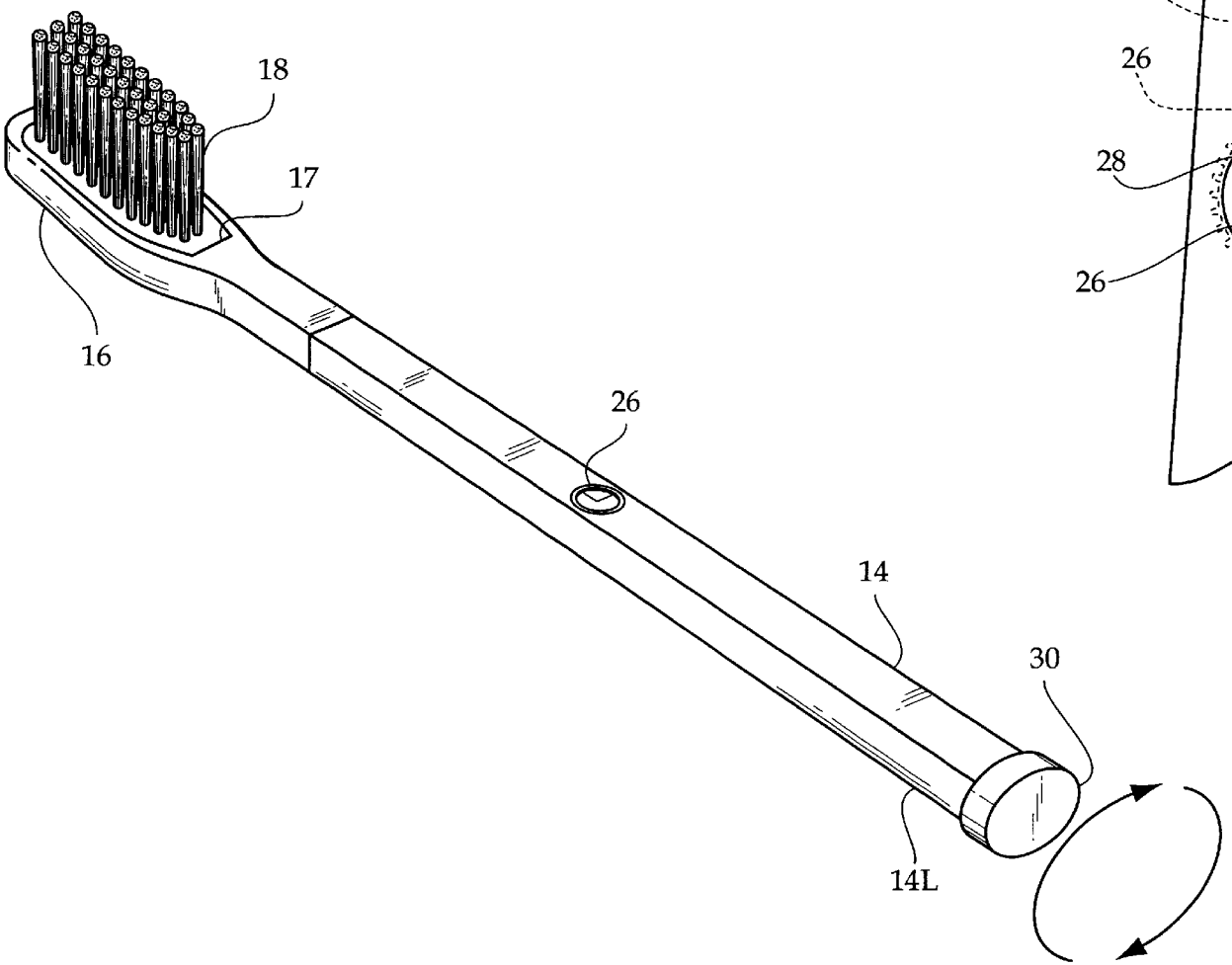
FIG. 4 is a perspective view of a second embodiment of the present invention.

A second embodiment of the present invention is shown in FIGS. 4 and 5 and includes substantially all of the components of the present invention wherein the slide member 24 is replaced by alternate mechanism for moving the internal plunger within the internal channel. In this embodiment, the handle 14 has an lower end 14L. The lower end 14L has a rotatable dial 30 disposed therein. The rotatable dial 30 is coupled with the internal plunger 25 whereby rotation of the rotatable dial 30 will move the internal plunger to force the toothpaste 22 out of the plurality of openings 17 of the head portion 16 and onto the bristles 18. According to this embodiment the slide member 24 and slide track 20 may be eliminated. However, the longitudinal bar 27 remains connected to the plunger 25, and remains engaged with the counter 26 through the counter gear 26 and rack teeth 29T. However, a worm gear 31 extends longitudinally within the handle 14 from the lower end 14L thereof and is coupled between the rotatable dial 30 and the rack teeth 29T of the longitudinal bar 27 so that rotation of the rotatable dial 30 will advance the rack 29, the longitudinal bar 27, and thus the plunger 25 to dispense the toothpaste. As seen in FIG. 5, the worm gear 31 might need to be off-axis with the center of the rotatable dial 30 but parallel thereto. Thus, a simple gearing arrangement can be employed at the rotatable dial 30 to effect the off-center positioning of the worm gear 31.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A combination toothbrush and toothpaste dispenser with incorporated remaining use counter for allowing toothpaste to be dispensed while keeping track of remaining uses prior to disposal comprising, in combination:

a toothbrush portion comprised of an elongated hollow handle having an incorporated head portion, the elongated hollow handle including an elongated slide track and an internal channel, the head portion having a plurality of openings in communication with the internal channel, the head portion having a plurality of bristles extending outwardly thereof, the handle holding a quantity of toothpaste within the internal channel;

a slide member slidably coupled with the slide track of the elongated hollow handle of the toothbrush portion;

an internal plunger disposed within the internal channel of the elongated hollow handle, the slide member coupled with the internal plunger for advancing the plunger within the handle toward the bristles whereby the internal plunger will force the toothpaste out of the plurality of openings of the head portion and onto the bristles; and a counter disposed within the elongated hollow handle of the toothbrush portion, the counter being slaved to the plunger for determining a remaining amount of toothpaste disposed therein, the counter having a dial indicator displaying remaining use prior to disposal, the counter not capable of itself advancing the plunger.

2. The combination toothbrush and toothpaste dispenser as recited in claim 1, further comprising a longitudinal bar which couples the plunger with the slide member, the counter having a counter gear which is engaged with the longitudinal bar for rotating the dial indicator in response to movement of the slide member, and thus the longitudinal bar.

3. The combination toothbrush and toothpaste dispenser as recited in claim 2, wherein the longitudinal bar has a rack having rack teeth which engage the counter gear to rotate the dial indicator.

4. The combination toothbrush and toothpaste dispenser as recited in claim 3, further comprising a flexible plate, located within the handle adjacent to the rack, so that as the rack moves past the flexible plate, the rack teeth cause it to click.

5. A combination toothbrush and toothpaste dispenser with incorporated remaining use counter for allowing toothpaste to be dispensed while keeping track of remaining uses prior to disposal comprising, in combination:

a toothbrush portion comprised of an elongated hollow handle having an incorporated head portion, the elongated hollow handle including an internal channel, the head portion having a plurality of openings in communication with the internal channel, the head portion having a plurality of bristles extending outwardly thereof, the handle holding a quantity of toothpaste within the internal channel wherein the handle has a lower end opposite from the head;

a rotatable dial at the lower end of the handle;

an internal plunger disposed within the internal channel of the elongated hollow handle, the rotatable dial coupled with the internal plunger with a longitudinal bar for advancing the plunger within the handle toward the bristles whereby the internal plunger will force the toothpaste out of the plurality of openings of the head portion and onto the bristles;

a counter disposed within the elongated hollow handle of the toothbrush portion, the counter being slaved to the plunger for determining a remaining amount of toothpaste disposed therein, the counter having a dial indicator displaying remaining use prior to disposal, the counter not capable of itself advancing the plunger, wherein the counter has a counter gear which is engaged with the longitudinal bar for rotating the dial indicator in response to movement of the longitudinal bar.

6. The combination toothbrush and toothpaste dispenser as recited in claim 5, wherein the longitudinal bar has a rack having rack teeth which engage the counter gear to rotate the dial indicator, and wherein a worm gear is coupled with the rotatable dial and the rack to advance the rack as the rotatable dial is rotated.

7. The combination toothbrush and toothpaste dispenser as recited in claim 6, further comprising a flexible plate, located within the handle adjacent to the rack, so that as the rack moves past the flexible plate, the rack teeth cause it to click.

* * * * *